United States Patent [19]

Grattapaglia et al.

[11] 4,126,993

[45] Nov. 28, 1978

[54] HYDRAULIC SYSTEM FOR AN EARTH-MOVING MACHINE AND A TEMPERATURE-CONTROLLED VALVE FOR A HYDRAULIC SYSTEM

[75] Inventors: Giorgio Grattapaglia, Turin; Rino Barbagli, Borgaretto (Turin), both of Italy

[73] Assignee: Fiat-Allis Macchine Movimento Terra, S.p.A, Lecce, Italy

[21] Appl. No.: 796,667

[22] Filed: May 13, 1977

[30] Foreign Application Priority Data

May 17, 1976 [IT] Italy ..... 68201 A/76

[51] Int. Cl.[2] ..... F15B 21/04

[52] U.S. Cl. ..... 60/329; 60/456; 60/DIG. 5; 137/468; 236/98

[58] Field of Search ..... 60/329, 456, DIG. 5; 137/468; 91/419; 236/98

[56] References Cited

U.S. PATENT DOCUMENTS

| | | | |
|---|---|---|---|
| 2,166,940 | 7/1939 | Conradson | 60/329 |
| 2,862,523 | 12/1958 | Obermaier | 60/329 X |
| 3,174,410 | 3/1965 | Booth et al. | 60/329 X |
| 3,401,605 | 9/1968 | Born | 60/DIG. 5 |

*Primary Examiner*—Edgar W. Geoghegan
*Attorney, Agent, or Firm*—August E. Roehrig, Jr.; Harvey W. Rockwell; Robert A. Brown

[57] ABSTRACT

A hydraulic system which is monitored to control the application of fluid power in response to the temperature of the hydraulic fluid and a temperature responsive valve for use in the hydraulic fluid circuit to monitor the temperature of the fluid to control the application of fluid power to components of the system.

8 Claims, 8 Drawing Figures

Fig. 2
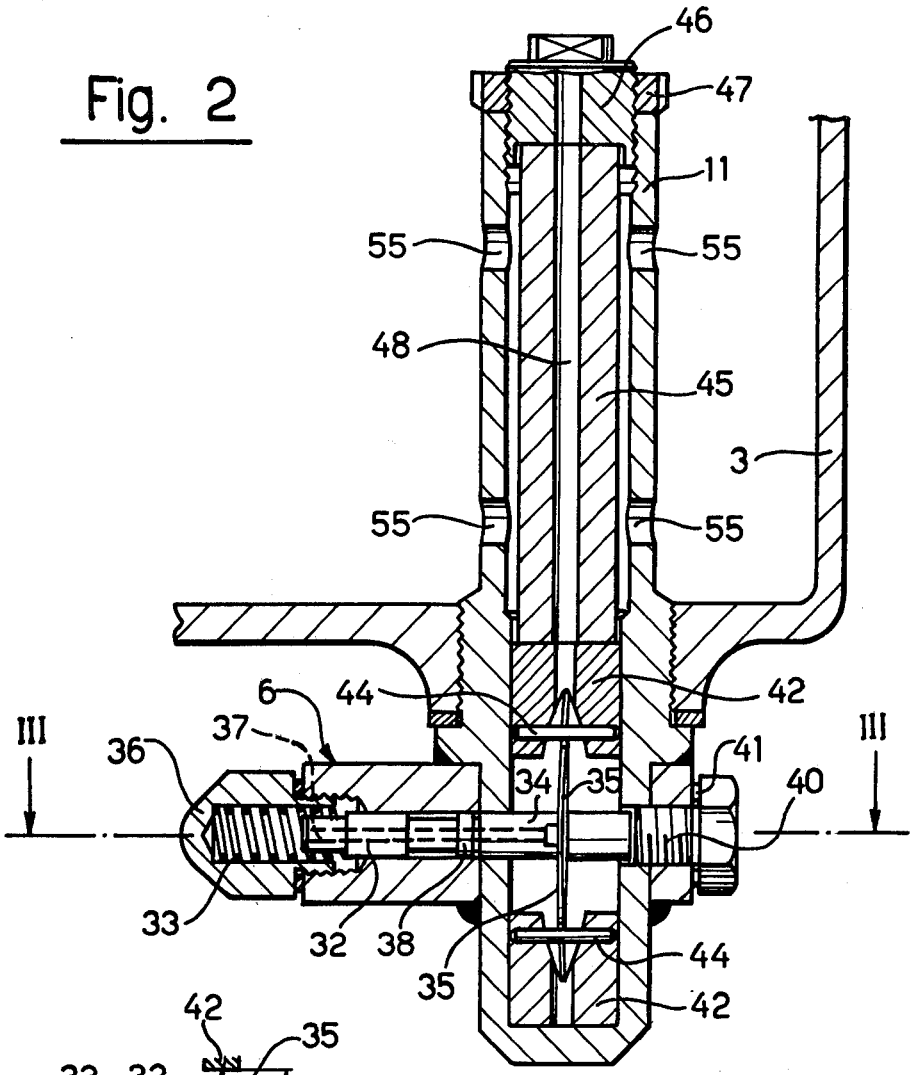
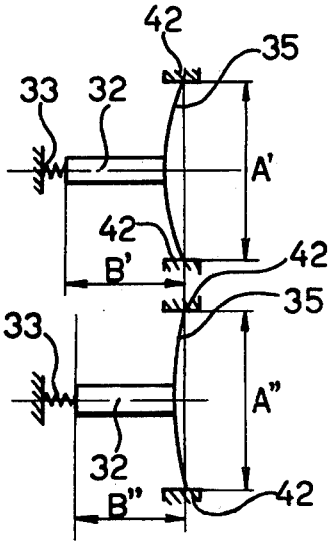
Fig. 5a
Fig. 5b

HYDRAULIC SYSTEM FOR AN EARTH-MOVING MACHINE AND A TEMPERATURE-CONTROLLED VALVE FOR A HYDRAULIC SYSTEM

BACKGROUND OF THE INVENTION

This invention relates in general to controls for hydraulic systems and, in particular, to a hydraulic system controller for limiting the application of hydraulic power in response to the temperature of the hydraulic fluid.

More specifically, but without restriction to the particular use which is shown and described, this invention relates to a hydraulic system controller which utilizes a temperature responsive valve to control application of hydraulic fluid power. The temperature responsive valve is actuated in response to the temperature of the hydraulic fluid utilized in the hydraulic system to thereby minimize stresses exerted on components of the system due to variations in fluid viscosity during operation.

In the use of hydraulic systems, for example as utilized in various earth moving and construction machinery equipment, the various equipment in which these hydraulic systems are employed are utilized in widely varying environmental conditions. Although many attempts have been made to develop hydraulic fluids which maintain a uniform viscosity throughout a given temperature range, these attempts have not yet produced a hydraulic fluid which does not vary in viscosity in relationship to the fluid temperature. Since the environmental conditions in which this equipment, and therefore these hydraulic systems, are employed varies throughout extreme temperatures, it has been found that in cold weather conditions the high viscosity of the hydraulic fluid creates a problem during start-up of the hydraulic system. The flow of the fluid, being very viscous, is such that the hydraulic pump is badly lubricated during start-up, and clearances between relatively movable mechanisms in the system change because of differentials in the coefficient of thermal expansion for various parts of the hydraulic pump and other components of the hydraulic system.

In order to minimize damage to the components of the hydraulic fluid system, the operator of the equipment must keep the machine engine running at a low speed until the temperature of the hydraulic fluid increases sufficiently to warm and lubricate the components of the system. However, heretofore this warm-up period has required special attention on the part of the equipment operator. The present invention eliminates the necessity of the equipment operator controlling operation of the engine by automatically limiting the pressure developed within the hydraulic fluid system in response to the temperature of the hydraulic fluid. While this invention is believed to have general application to any type of hydraulic fluid system, for convenience of illustration the preferred embodiment is described with reference to its use in earth moving or construction machinery equipment.

SUMMARY OF THE INVENTION

It is, therefore, an object of this invention to improve hydraulic fluid systems.

Another object of this invention is to improve hydraulic fluid systems employed in earth moving or construction machinery equipment.

A further object of this invention is to control the pressure developed in a hydraulic fluid system in response to the temperature of the hydraulic fluid.

Still another object of this invention is to monitor the temperature of the hydraulic fluid and control the amount of fluid flow in response to the temperature of the hydraulic fluid.

These and other objects are attained in accordance with the present invention wherein there is provided a hydraulic system which is monitored to control the application of fluid power in response to the temperature of the hydraulic fluid and a temperature responsive valve for use in the hydraulic fluid circuit to monitor the temperature of the fluid to control the application of fluid power to components of the system.

DESCRIPTION OF THE DRAWINGS

Further objects of the invention, together with additional features contributing thereto and advantages accruing therefrom, will be apparent from the following description of a preferred embodiment of the invention which is shown in the accompanying drawings with like reference numerals indicating corresponding parts throughout, wherein:

FIG. 2 is a vertical cross section taken through a first temperature-control valve constructed in accordance with the invention, taken along line 2—2 of FIG. 3;

FIGS. 5*a* and 5*b* are diagrammatic illustrations of the operation of the temperature-control valve of FIG. 2;

DESCRIPTION OF A PREFERRED EMBODIMENT

Figure 1:
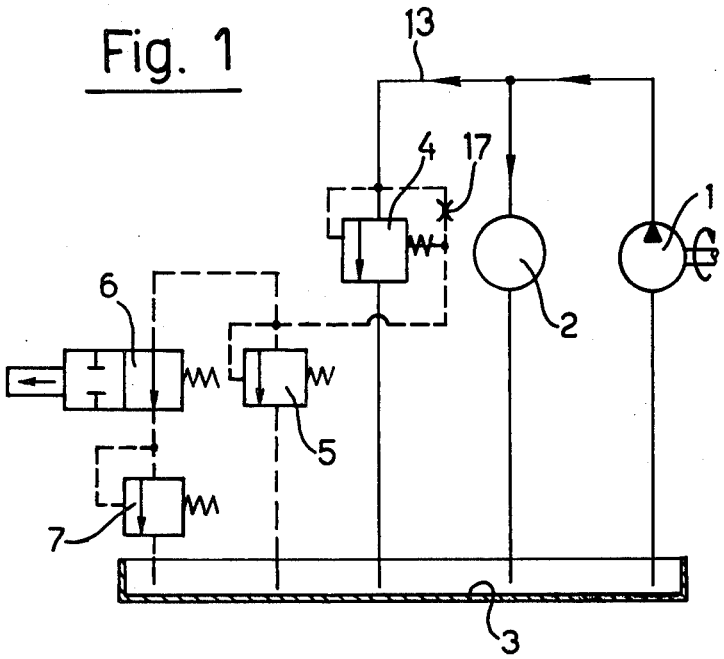
FIG. 1 is a hydraulic schematic of the hydraulic fluid system in accordance with the present invention.

Referring now to FIG. 1, there is shown a schematic of a hydraulic system employing a typical hydraulic fluid pump 1, which may be a positive constant volume displacement pump, one or more hydraulic actuators or motors 2, a sump or tank 3, a relief valve arrangement which includes a dump or relief valve 4, and downstream of the relief valve 4 a pressure-controlled pilot valve 5 connected into the fluid circuit in parallel with a series-connected temperature-controlled valve 6 and a pressure controlled pilot valve 7. While in general it has been found desirable to use a single pilot-controlled relief valve, in view of the relatively large quantity of hydraulic fluid which must be returned to the sump 3, in an alternative embodiment it would be possible to have the temperature-controlled valve 6 in parallel with the relief valve.

The temperature-controlled valve 6, as indicated in a conventional manner, is normally opened and as described in detail hereinafter is set so that it does not close until a certain temperature is reached. The pressure-controlled pilot valve 7 is set to be actuated by a relatively low pressure, for example 50 bar (about 50Kg/cm$^2$) while the pressure-controlled pilot valve 5 is set to be actuated by the normal working pressure of the hydraulic system which is usually substantially above the pressure to which the pressure-controlled pilot valve 7 is set, for example 160 bar (about 165 Kg/cm$^2$).

Figure 3:
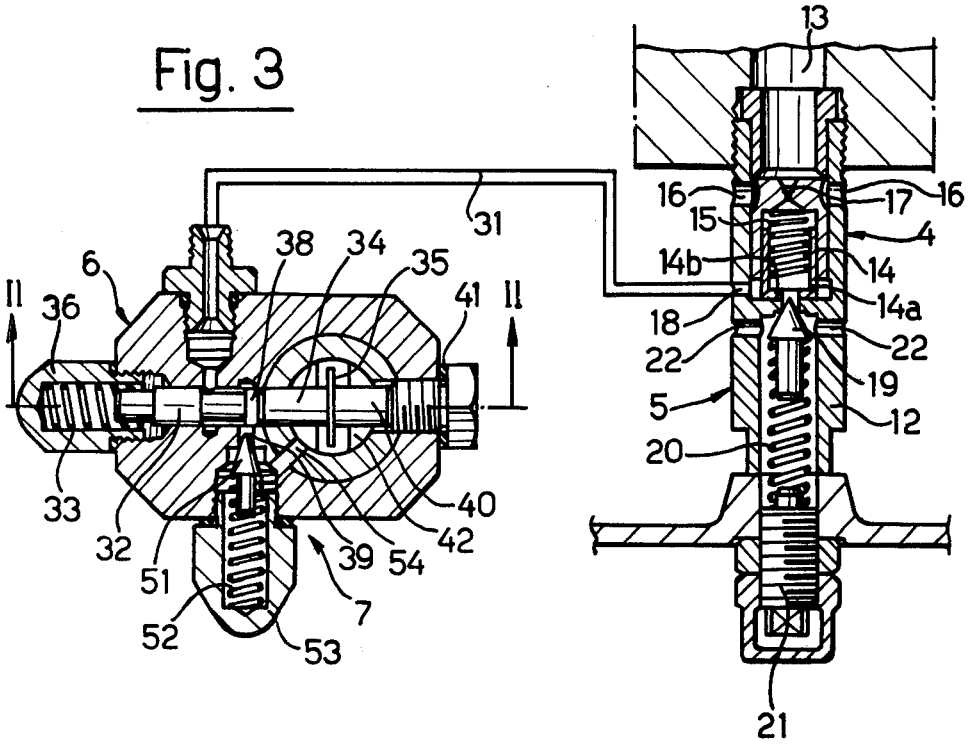
FIG. 3 is a sectional view of the temperature-control valve of FIG. 2 taken along line 3—3 of FIG. 2 and a corresponding section through two associated valves.
Figure 4:
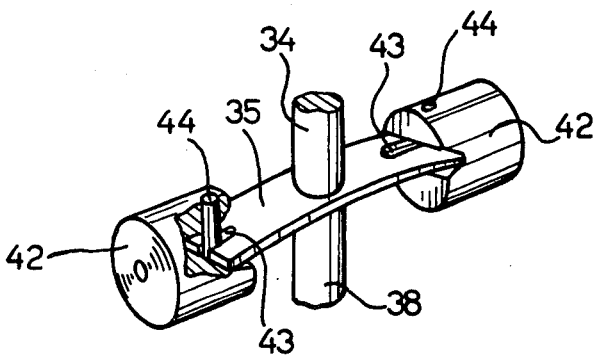
FIG. 4 is an enlarged perspective view of parts of the temperature-control valve of FIG. 2.

The temperature-controlled valve 6, the details of which are best shown in FIGS. 2–4, includes a projecting casing portion 11 which carries a male thread and is secured into the base of the sump 3 with a conventional sealing arrangement to prevent fluid leakage. The dump or relief valve 4 and the pressure-controlled pilot valve 5, best shown in detail in FIG. 3, are mounted within a discharge chamber of a distributor in series with the hydraulic fluid pump 1 and hydraulic actuators for motors 2. The relief valve 4 and pilot valve 5 are utilized in a single casing 12 which is connected by means of a duct 13 to the pressure side of the hydraulic fluid pump 1. The dump or relief valve 4 has a hollow sliding piston 14 which slides on a cup 14*a*, bias loaded by a spring 15. A plurality of radial bores 16 are provided to allow hydraulic flid to escape directly into the fluid discharge chamber when the piston 14 is depressed to slide relative to the cup 14*a*. The piston 14 has a relatively narrow bore 17 through its head to provide fluid communication through a small aperture 14*b* in the cup 14*a* to a radial port 18 and to the pressure-controlled pilot valve 5.

The pressure-controlled pilot valve 5 is constructed in the form of a poppet 19 which is biased or loaded by a spring 20 whose pressure can be adjusted by an adjustable plug 21 or any other conventional adjusting arrangement. Radial bores 22 are formed in the casing 12 to communicate directly with the distributor discharge chamber. The pressure-controlled pilot valve 5 functions to control the normal operating pressure of the hydraulic system. When the valve is opened, pressure under piston 14 is relieved, allowing the dump or relief valve 4 to open.

The radial connection or port 18 formed in casing 12 is connected to the temperature-controlled valve 6 by means of a suitable duct or conduit 31. The temperature-controlled valve 6 includes a valve member in the form of a pressure-balanced sliding valve member or spool 32 whose left hand end portion (referring to FIG. 3) is biased or loaded by means of a compression spring 33 and whose right hand end portion 34 directly abuts a leaf spring 35 for transmitting motion. The biasing spring 33 is retained by a cup 36 which is vented by means of a longitudinal bore 37 formed internally of the spool 32 and best shown in FIG. 2.

Referring again to FIG. 3, the spool 32, which is shown in its right hand position, has a control land 38 which cooperates with a bore or valve port 39. The port 39 must have a sufficiently large diameter to allow for the initial adjustment of the position of the spool 32 and to permit a sufficiently large flow rate through the temperature-controlled valve 6. However, the diameter of bore 39 must be small enough such that the temperature-controlled valve 6 is a substantially two-position valve, moving completely from a fully opened position to a fully closed position in response to a small temperature range thereby giving substantially no progressive control of the relief of pressure therethrough. While the preferred embodiment discloses that the outlet of temperature-controlled valve 6 is controlled, in an alternative embodiment, however, it would be possible to control the inlet rather than the outlet. The positioning of the spool 32 in its right hand extreme position (as shown in FIG. 3) is controlled by an adjustable abutment comprising a conventional screw-in plug 40 whose position is adjustable by the insertion or removal of shims 41.

Actuation of the temperature-controlled valve 6 is effected through a system including a leaf spring 35 and a temperature-sensitive element 45. As best shown in FIGS. 2, 4, and 5*b*, the leaf spring 35 has a slight arcuate curve, though in an alternative embodiment the leaf spring 35 could be a very obtuse angled V, in its initial position when the hydraulic fluid is cold. It should be noted that in its unstressed condition the leaf spring 35 may be flat, being stressed into a curved position by the adjustable plug 40 which abuts the leaf spring 35 and further to adjust the temperature response. As best shown in FIG. 2, the end portions of the spring 35 abut a fixed seat and a movable seat. The seats are formed by generally V-notches in identical cylindrical blocks 42 which may be of low-carbon steel. The spring 35 is operatively connected to the cylindrical blocks 42 by means of an open ended slot 43 in each end of the spring 35 (FIG. 4) forming a bifurcated end encompassing a pin 44 to traverse the respective notches formed in the cylindrical blocks 42. The lower block 42 (FIG. 2) is held stationary in a circular blind bore at the bottom of the casing 11 of the temperature-controlled valve 6. The upper block 42 is slidable in a circular bore co-axial with the blind bore and abuts a temperature-sensitive element 45 which functions to move the upper cylindrical block 42 in the bore to thereby effect movement of the spring 35 and valve spool 32 in response to changes in temperature.

The temperature-sensitive element 45 is carried within the projected casing portion 11 and comprises a length of cylindrical material having a coefficient of thermal expansion substantially different to that of the casing portion 11. Though it would be possible to design the temperature-sensitive device in the opposite manner, in the preferred embodiment disclosed herein the temperature sensitive element 45 is made of a plastic such as a stabilized or glass filed superpolyamide 6 or 66, while the casing portion 11 is made of a low-carbon steel. Therefore, the temperature-sensitive element 45 has a substantially greater coefficient of thermal expansion than the casing portion 11 and the spring 35 resting against the adjustable plug 40 when the temperature-sensitive element 45 is cold.

As the temperature increases, the temperature-sensitive element 45 increases the distortion of the leaf spring 35 in that the end portions of the spring 35 are moved toward or away from each other in accordance with the movement of the temperature-sensitive element 45. The bending of the spring 35 moves the center part of the spring in a direction at right angles to the relative movement between the ends of the spring and, in this manner as best illustrated in FIGS. 5*a* and 5*b*, the spring 35 acts as a transmitting link to substantially magnify the movement of the temperature-sensitive element 45. The temperature-sensitive element 45 is provided with a central bore 48 extending therethrough in communication with a similar bore formed in the top block 42 and the plug 46 for a purpose to be hereinafter explained in detail.

Referring to FIGS. 5*a* and 5*b*, there is illustrated the distance A′ and A″ between the two pins 44 in a typical hot and cold condition of the temperature-sensitive element 45, and the distance B′ and B″ between the left hand end of the spool 32 and the center line of the temperature-sensitive element 45. As is illustrated, the distance A″–A′ is less than the distance B′–B″ to illustrate the magnification of this movement. In order to adjust the actuation of the temperature-sensitive valve 6 through varying temperature ranges, the initial position of the temperature-sensitive element 45 may be adjusted by means of a plug 46 having a lock-nut 47 secured thereto.

Referring again to FIG. 3, it is shown that the bore of the temperature-controlled valve 6 is connected in series to the pressure-controlled pilot valve 7 and, as illustrated, both valves may be in the same casing. While the pressure-controlled pilot valve 7 is not necessary for a workable system, it is desirable to permit the hydraulic system to operate at low speed or low loads until the oil has reached the desired temperature. Therefore, the valve 7 is provided and set to the low pressure previously disclosed. Due to the series connection of the pressure-controlled pilot valve 7 and the temperature-controlled valve 6, fluid is not discharged through the temperature-controlled valve 6 if the oil pressure is very low insuring that there is always some residual pressure in the hydraulic system.

The pressure-controlled pilot valve 7 includes a poppet 51 which is biased or spring loaded by a spring 52 retained by a cup 53. The outlet from the pressure-controlled valve 7 is coupled in fluid communication by means of a bore 54 to the chamber containing the leaf spring 35 and the bore 48 in the plug 46 and into the sump 3. Ports or lateral bores 55 formed in the casing portion 11 communicate the fluid in the sump 3 with the internal portion of casing 11. In this manner, the temperature-sensitive element 45 is not only immersed in the hydraulic fluid in the sump 3, but the fluid passing through the temperature-controlled valve 6 while the valve 6 is open is in intimate contact with the temperature-sensitive element 45. This contact with the fluid insures that the temperature-controlled valve 6 has a fast response to the rise in temperature of the fluid.

Figure 6:
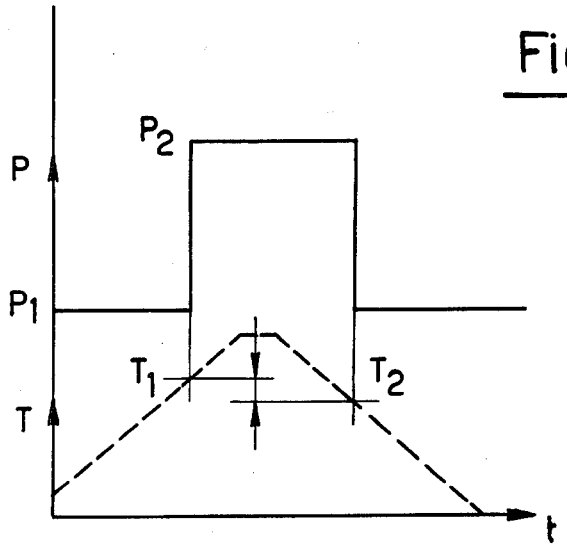
FIG. 6 is a graph illustrating the operation of the temperature-control valve of FIG. 2.

The relationship between the pressure P and temperature T, in relationship to time *t*, is illustrated in the graph of FIG. 6, wherein it is shown that there is an abrupt rise in pressure from the valve $P_1$, controlled by the pressure-controlled pilot valve 7, to a value $P_2$, controlled by the pressure-controlled pilot valve 5, when the temperature-controlled valve 6 closes. While there is hysteresis due to thermal lag and friction, the temperature-controlled valve 6 closes at temperature T-1 on rise of temperature, and opens at temperature T-2 on fall of temperature. However, this differential is not significant as it is the closing of the temperature-control valve 6 on a rise of temperature which is important. Nevertheless, the temperature difference ($T_1$–$T_2$), or hysteresis, prevents the temperature controlled valve 6 from hunting should there be small oscillations of temperature around the value $T_1$.

In one example the temperature $T_1$ was controlled with good repeatability to a range of 5° C, in that specific example from 60° to 65° C, and this temperature response can be altered merely by the adjustment of the plug 46 or the plug 40.

Figure 7:
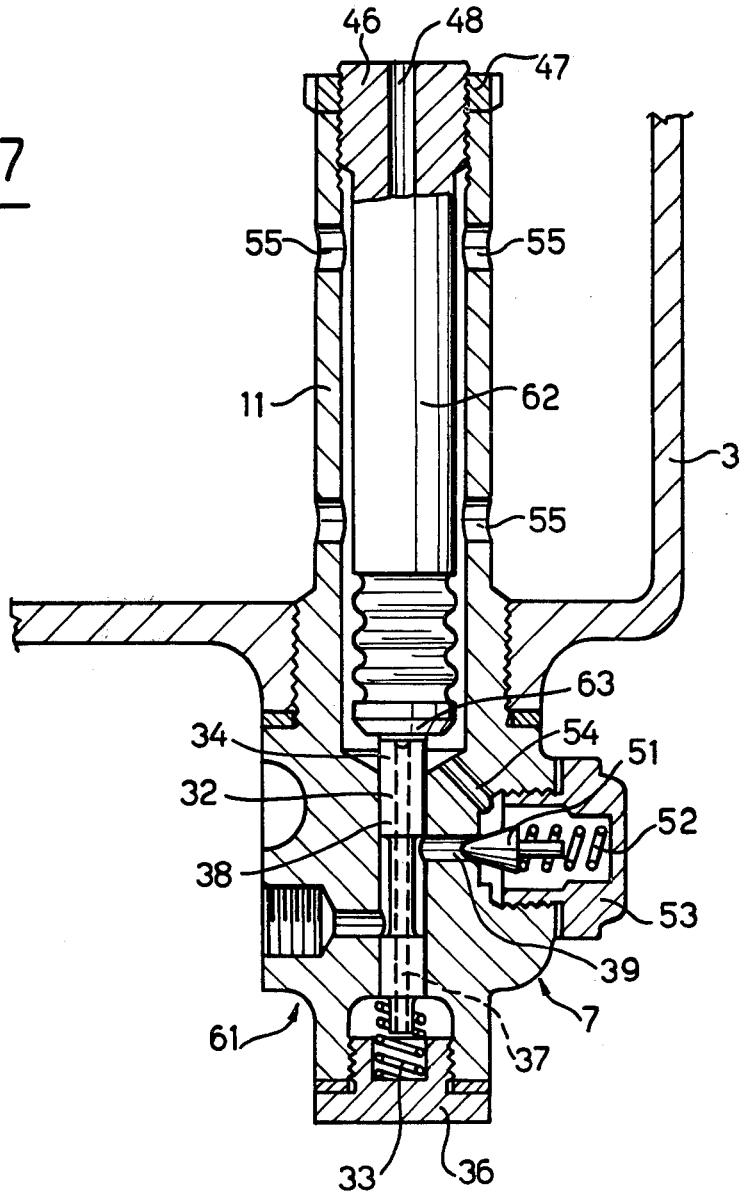
FIG. 7 is a vertical section of a second temperature-control valve corresponding to that valve illustrated in FIG. 2 and constructed in accordance with the present invention.

Referring now to FIG. 7, there is shown a temperature-controlled valve 61 which has many parts which are similar in function to the temperature-controlled valve 6 shown in FIGS. 2 and 3. Although these parts in some instances may not have the same shape, they are indicated in FIG. 7 with the same reference numerals as those in FIGS. 2 and 3. The temperature-controlled valve 61 shown in FIG. 7 has a temperature-sensitive element in the form of an actuator 62, whose terminal part 63 moves longitudinally on temperature change. The spool 32 is aligned with the actuator 62 and its top portion 34 is biased by a spring 33 into direct abutment with a portion 63 of the actuator 62. The actuator 62 is preferably of the type providing a substantial movement of the portion 63 over a small temperature range to give a rapid, rather than a gradual movement to the spool 32.

Adjustment of the initial position of the spool 32 is effected by movement of the adjustable plug 46 to which the actuator 32 may be fixed. The adjustable plug 46 need not be provided with a bore 48, however, if such a bore is provided, a suitable duct must be included to communicate with the interior of the casing 11.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. An automatically controlled hydraulic system for use throughout varied environmental conditions comprising a hydraulic pump for creating a pressurized supply of hydraulic fluid for communication to hydraulic actuators, hydraulic actuators coupled to said hydraulic pump for actuation in response to the pressurized hydraulic fluid supplied thereto and normally open temperature-responsive valve means coupled with said hydraulic pump and said hydraulic actuators to by-pass pressurized hydraulic fluid communication between said hydraulic pump and said hydraulic actuators, and actuable to a closed position to effect pressurized hydraulic fluid communication therebetween in response to the temperature of the pressurized hydraulic fluid increasing to a predetermined temperature above that temperature at which said valve means is normally open.

2. The hydraulic system as set forth in claim 1 wherein said temperature responsive valve means includes a pressure actuated relief valve for relieving the hydraulic system of pressures exceeding a predetermined limit.

3. The hydraulic system as set forth in claim 2 wherein the predetermined limit of said pressure actuated relief valve is determined in response to the temperature of the hydraulic fluid.

4. The hydraulic system as set forth in claim 2 wherein said temperature responsive valve means includes a temperature-controlled pilot valve operatively connected to said pressure actuated relief valve to control the opening and closing thereof.

5. The apparatus of claim 4 further including a pressure-controlled pilot valve operatively connected in series fluid communication with said temperature-controlled valve to communicate pressurized hydraulic fluid between said hydraulic pump and said hydraulic actuator in response to a predetermined actuating pressure.

6. The hydraulic system as set forth in claim 4 wherein said temperature-controlled valve as a controlling temperature-sensitive element associated therewith and positioned in thermal contact with the pressurized supply of hydraulic fluid.

7. A temperature-controlled valve for use in a system for controlling communication of pressurized hydraulic fluid comprising a casing in fluid communication with a supply of pressurized hydraulic fluid, port means for passing the pressurized hydraulic fluid therethrough, a temperature-sensitive element carried within said casing for movement in response to the temperature of the pressurized hydraulic fluid, and means operatively connected to said temperature-sensitive element for opening and closing said port means in response to the movement of said temperature-sensitive element, including spring means fixedly secured at one end and operatively connected to said temperature-sensitive element at another end to translate the movement thereof for effecting the opening and closing of said port means, each of said ends of said spring being means being bifurcated and engaging substantially identical cylindrical blocks carried within said casing in a position co-axial with said temperature-sensitive element.

8. The apparatus of claim 7 further including valve spool means operatively connected to said spring means and movable in response thereto for opening and closing said port means.

* * * * *